US005634168A

United States Patent [19]

Matsumoto et al.

[11] Patent Number: 5,634,168

[45] Date of Patent: May 27, 1997

[54] PHOTOSENSITIVE MATERIAL PROCESSING APPARATUS

[75] Inventors: Nobuo Matsumoto; Hisatsugu Torii, both of Kanagawa, Japan

[73] Assignee: Fuji Photo Film Co., Ltd., Kanagawa, Japan

[21] Appl. No.: 558,871

[22] Filed: Nov. 16, 1995

[30] Foreign Application Priority Data

Jan. 25, 1995 [JP] Japan ..... 7-010088

[51] Int. Cl.[6] ..... G03D 3/08

[52] U.S. Cl. ..... 396/612; 396/636; 396/617

[58] Field of Search ..... 354/319–322, 354/324, 331, 336; 134/64 P, 64 R, 122 P, 122 R

[56] References Cited

U.S. PATENT DOCUMENTS 4,256,398 3/1981 Ohtani ..... 354/320
4,613,223 9/1986 Cherry et al. ..... 354/322
4,933,699 6/1990 Nakamura et al. ..... 354/320
5,043,756 8/1991 Takabayashi et al. ..... 354/320
5,223,883 6/1993 Suzuki ..... 354/320
5,499,073 3/1996 Pummell ..... 354/320

*Primary Examiner*—D. Rutledge
*Attorney, Agent, or Firm*—Sughrue, Mion, Zinn, Macpeak & Seas

[57] ABSTRACT

A photosensitive material processing apparatus prevents a developing solution from adhering to a photosensitive material before it is fed into a developing tank, so as not to cause developer streaks. A holding member which supports inlet guide rollers and a holding member which supports outlet guide rollers can independently be taken out of a transport rack for cleaning. The developing solution dripped from the outlet guide rollers does not adhere to the inlet guide rollers. Accordingly, unevenness in development can be prevented, which would occur when the developing solution adheres to the transported photosensitive material before it enters the processing solution.

16 Claims, 11 Drawing Sheets

PHOTOSENSITIVE MATERIAL PROCESSING APPARATUS

BACKGROUND OF THE INVENTION

1. Field of the Invention

The present invention relates to a photosensitive material processing apparatus for feeding a photosensitive material into a processing tank such as a developing tank to develop the photosensitive material.

2. Description of Related Art

In a photosensitive material processing apparatus, a photosensitive material such as photographic film or photographic printing paper, on which an image has been exposed, is fed into a developing apparatus. In the developing apparatus, the photosensitive material is successively passed through a series of processing tanks such as a developing tank and a fixing tank. In detail, the photosensitive material is fed into a processing tank while being nipped by inlet guide rollers provided at the inlet of the processing tank. After being passed through a processing solution in the processing tank, the photosensitive material is pulled out of the processing tank and is transported to the next stage while being nipped and driven by outlet guide rollers provided at the outlet of the processing tank.

When the photosensitive material enters a developing tank, a developing solution contacts the photosensitive material, thereby starting development. If the developing solution contacts a portion of the photosensitive material before that portion enters the developing solution, development of that portion progresses faster than the remaining portion. This causes developer streaks or unevenness in development. The contact of a developing solution to a photosensitive material at an early stage of processing occurs when the developing solution which has carelessly soiled the inlet guide rollers contacts the photosensitive material. The developing solution on the inlet guide rollers sometimes produces, due to oxidation thereof, a substance which suppresses the developing reaction. In such a case, development is delayed with a portion soiled by the developing solution. This also causes developer streaks or unevenness in development.

The reason why a developing solution can be unintentionally adhered to the inlet guide rollers is that when the developing solution smudges a certain stationary guide roller which is located above the solution and the photosensitive material hits the stationary guide roller, the developing solution splashes, and the splashed developing solution sometimes adheres to the inlet guide rollers. Further, when the inlet guide rollers and the outlet guide rollers are both taken out for cleaning, the developing solution carried on the outlet guide rollers as the photosensitive material is transported drips onto the inlet guide rollers after the outlet guide rollers are taken out. Moreover, there is a possibility that developing solution evaporated due to heat contacts the inlet guide rollers and condenses into drips as the temperature decreases, so that the developing solution adheres to the inlet guide rollers.

SUMMARY OF THE INVENTION

The present invention has been accomplished by taking the above-mentioned facts into consideration, and the object of the present invention is to provide an improved photosensitive material processing apparatus which prevents unevenness in processing caused by adhesion of a processing solution to a photosensitive material before it is immersed into the processing solution.

According to a first aspect of the present invention, there is provided a photosensitive material processing apparatus in which a transport rack is provided and a photosensitive material is immersed into a processing tank filled with a processing solution such as a developing solution for processing the photosensitive material. The photosensitive material processing apparatus comprises an inlet guide section provided at an inlet section of the processing tank and adapted to contact the photosensitive material before immersion to feed the photosensitive material into the processing tank. The inlet guide section is removably provided on an upper portion of the transport rack. The apparatus also comprises an outlet guide section provided in an outlet section of the processing tank and adapted to contact the photosensitive material after immersion to feed out the photosensitive material from the processing tank. The outlet guide section is provided on the upper portion of the transport rack such that the outlet guide section is removable from the transport rack independent from the inlet guide section.

According to a second aspect of the present invention, there is provided a photosensitive material processing apparatus in which a transport rack is provided and a photosensitive material is immersed into a processing tank filled with a processing solution such as a developing solution for processing the photosensitive material. The photosensitive material processing apparatus comprises an inlet guide section provided at an inlet section of the processing tank and adapted to contact the photosensitive material before immersion to feed the photosensitive material into the processing tank, an outlet guide section provided at an outlet section of the processing tank and adapted to contact the photosensitive material after immersion to feed out the photosensitive material, a holding member for holding the inlet guide section and the outlet guide section together, and removable from the transport rack, and a dripping preventing device for preventing the processing solution adhering to the outlet guide section from dripping onto the inlet guide section in a state in which the holding member is removed from the transport rack.

According to a third aspect of the present invention, there is provided a photosensitive material processing apparatus, wherein the dripping preventing device has a partition member having a tip portion which projects toward the processing tank from a straight line connecting a lowermost portion of the inlet guide section which faces the processing tank, and a lowermost portion of the outlet guide section which faces the processing tank.

According to a fourth aspect of the present invention, there is provided a photosensitive material processing apparatus in which a transport rack which rotatably supports transport rollers, is provided and a photosensitive material is transported by the transport rollers so that the photosensitive material is immersed into a processing tank filled with a processing solution such as a developing solution for processing the photosensitive material. The photosensitive material processing apparatus comprises an inlet guide roller disposed at an inlet of the processing tank above the surface of the processing solution and adapted to contact the photosensitive material to guide the photosensitive material into the processing tank and a one-way clutch for transmitting drive force to the inlet guide roller from a drive source which drives the transport rollers supported by the transport rack and for allowing the inlet guide roller to independently rotate in the direction of feed of the photosensitive material.

According to a fifth aspect of the present invention, there is provided a photosensitive material processing apparatus in which a photosensitive material is immersed into a processing tank filled with a processing solution such as a developing solution for processing the photosensitive material. The photosensitive material processing apparatus comprises an inlet guide section provided at an inlet section of the processing tank and adapted to contact the photosensitive material before immersion to feed the photosensitive material into the processing tank, an outlet guide section provided at an outlet section of the processing tank and adapted to contact the photosensitive material after immersion to feed out the photosensitive material from the processing tank, a first door member for opening and closing an opening between the inlet guide section and the processing tank, and a second door member for opening and closing an opening between the outlet guide section and the outside.

According to a sixth aspect of the present invention, there is provided a photosensitive material processing apparatus in which a photosensitive material is immersed into a processing tank filled with a processing solution such as a developing solution for processing the photosensitive material. The photosensitive material processing apparatus comprises an inlet guide roller provided at an inlet section of the processing tank and adapted to feed the photosensitive material before immersion into the processing tank, a stationary guide provided between the inlet guide roller of the processing tank and the processing tank to guide the photosensitive material which runs from the inlet guide roller to the processing tank, and an adhesion preventing member for preventing the processing solution which splashes due to contact between the photosensitive material and the stationary guide from adhering to the inlet guide roller.

According to a seventh aspect of the present invention, there is provided a photosensitive material processing apparatus in which after heating a processing tank to a predetermined temperature, a photosensitive material is transported by an inlet guide section provided at an inlet section so that the photosensitive material is immersed into a processing tank for processing the photosensitive material. The photosensitive material processing apparatus comprises a drying device for drying the inlet guide section, and a control apparatus for making it possible to feed the photosensitive material into the processing tank when a predetermined period of time has elapsed, the predetermined period of time being the longer one of a heating period required to heat the processing tank to the predetermined temperature, and a drying period during which drying operation is performed by the drying device.

In the first aspect of the present invention, the inlet guide section and the output guide section can be removed from the transport rack, and such removal can independently be performed. In a state in which the processing of a photosensitive material is completed or interrupted, these guide sections are separately removed from the transport rack for cleaning and checking. Alternatively, only the outlet guide section is removed for work while the inlet guide section is maintained attached to the transport rack. Accordingly, it is possible to solve the conventional problem that when the inlet guide section and the outlet guide section are taken out together for cleaning and checking, the processing solution which has adhered to the outlet guide section due to contact with a photosensitive material after immersion into the processing solution, drips onto the inlet guide section. Accordingly, it is possible to solve the problem that the processing solution adheres to the inlet guide section, and the processing solution adhering to the inlet guide section then adheres to a photosensitive material while the photosensitive material is guided.

In the second aspect of the present invention, the inlet guide section and the outlet guide section are attached together to the holding member, which can be removed from the transport rack. Therefore, when the inlet guide section and the outlet guide section are cleaned and checked, they are both taken out from the transport rack, and placed at a different location where the inlet guide section and the outlet guide section are cleaned and checked. When the orientation of the holding member is changed during such work, the outlet guide section is sometimes disposed above the inlet guide section. In such a case, the developing solution adhering to the outlet guide section drips. Since the dripped processing solution is received by the drip preventing device, the dripped processing solution does not reach the inlet guide section, so that the processing solution is prevented from adhering to the inlet guide section.

In the third aspect of the present invention a partition member is used as the drip preventing device in the second aspect. The partition member has a tip portion which projects toward the processing tank from a straight line connecting a lowermost portion of the inlet guide section facing the processing tank, and a lowermost portion of the outlet guide section facing the processing tank. Accordingly, when the orientation of the holding member is changed such that the outlet guide section is located above the inlet guide section, the developing solution adhering to the outlet guide section drips. However, since the dripped processing solution is received by the partition member, the dripped processing solution does not adhere to the inlet guide section.

In the fourth aspect of the present invention, the inlet guide roller is connected to the drive source via the one-way clutch. Accordingly, the drive source drives the transport rollers of the transport rack and also drives the inlet guide roller, so that a photosensitive material is driven by the inlet guide roller and the transport rollers of the transport rack to be immersed into the processing solution. When the inlet guide roller is cleaned and checked, the inlet guide roller can be rotated, independently of the transport rollers, in the direction feed of the photosensitive material. Accordingly, the cleaning and checking can easily and reliably be performed while rotating the inlet guide roller. The one-way clutch used here is an ordinary type in which rotation of the drive source is transmitted to a driven member when the rotational direction is a predetermined direction but is not transmitted when the rotational direction is opposite to the predetermined direction.

In the fifth aspect of the present invention, the opening between the inlet guide section and the processing tank is opened and closed by the first door member, and the opening between the outlet guide section and the outside, which is downstream side of the outlet guide section, is opened and closed by the second door member. When a photosensitive material enters the processing tank, the first door member is opened to allow the passage of the photosensitive material. However, when no photosensitive material is transported, the first door is closed to prevent the developing solution from adhering to the inlet guide section due to evaporation and splashing. The second door member is opened when the photosensitive material taken out of the processing tank is transported to the downstream side, and is closed after the transport. This solved the conventional problem that the processing solution leaks to the outside due to evaporation and splashing, and reaches the inlet guide section. The door member can be formed by a shutter, and an open/close drive device such as a motor and a solenoid for driving the shutter. The presence and absence of the photosensitive material is detected by a contact type or non-contact type sensor to control the open/close drive device.

In the sixth aspect of the present invention, the adhesion preventing member is provided to prevent the processing solution splashed from the stationary guide from adhering to the inlet guide roller. The processing solution in the processing tank sometimes adheres to the stationary guide due to splashing and capillary action. Therefore, when the photosensitive material fed by the inlet guide roller hits the stationary guide, the processing solution squeezed by the photosensitive material and the stationary guide sometimes splashes. Since the splashed processing solution is caught by the adhesion preventing member, the splashed processing solution does not adhere to the inlet guide roller. Accordingly, unevenness is not produced in the quality of processing, because the processing solution does not adhere to the photosensitive material before the photosensitive material enters the processing tank.

In the seventh aspect of the present invention, the controller feeds a photosensitive material into the processing tank when a predetermined period of time has elapsed, which predetermined time is the longer one of a heating period required to heat the processing tank to the predetermined temperature, and a drying period during which drying operation is performed by the drying device. The heating device such as a heater brings the developing apparatus into a standby state during the time when the processing tank is heated to a temperature proper for development, for example, a temperature in the range of 38°–50°. This heating period of the heating device includes the period of time required to check the operation of the transport rollers for transporting the photosensitive material. When the processing solution adheres to the inlet guide roller, the drying device supplies hot air or the like to quickly dry the inlet guide roller. When a longer one of the heating period and the drying period has elapsed, it becomes possible to feed the photosensitive material into the processing tank. Therefore, even when the processing solution is present on the inlet guide roller, it is dried before the photosensitive material is fed into the processing tank. Accordingly, there is no possibility that the processing starts before the photosensitive material is immersed into the processing solution. This prevents the generation of unevenness in processing. As to the drying period, the lower the room temperature, the longer the period of time during which the air is supplied. The higher the room temperature, the shorter the period of time during which the air is supplied. Also, such control is performed based on the lowest temperature during a predetermined period of time (for example, 24 hours) before use. That is, when the room temperature or the lowest temperature before use is low, the amount of the processing solution condensed on the inlet guide roller increases. In such case, the drying period is increased. Also, when the period from the time when the temperature becomes lowest during 24 hours before use to the time when use of the developing apparatus starts is longer, a larger amount of the processing solution condensed on the inlet guide roller has evaporated. In such case, the drying period is decreased. On the contrary, when the above-mentioned period decreases, the drying period is increased. The drying period may be increased when the outside humidity is high and may be decreased when the outside humidity is low.

The above and other objects, features, and advantages of the present invention will become apparent from the following description and the appended claims, taken in conjunction with the accompanying drawings in which preferred embodiments of the present invention are shown by way of illustrative example.

BRIEF DESCRIPTION OF THE ACCOMPANYING DRAWINGS

The invention will now be described with reference to the accompanying drawings wherein.

DESCRIPTION OF PREFERRED EMBODIMENTS

Figure 1:
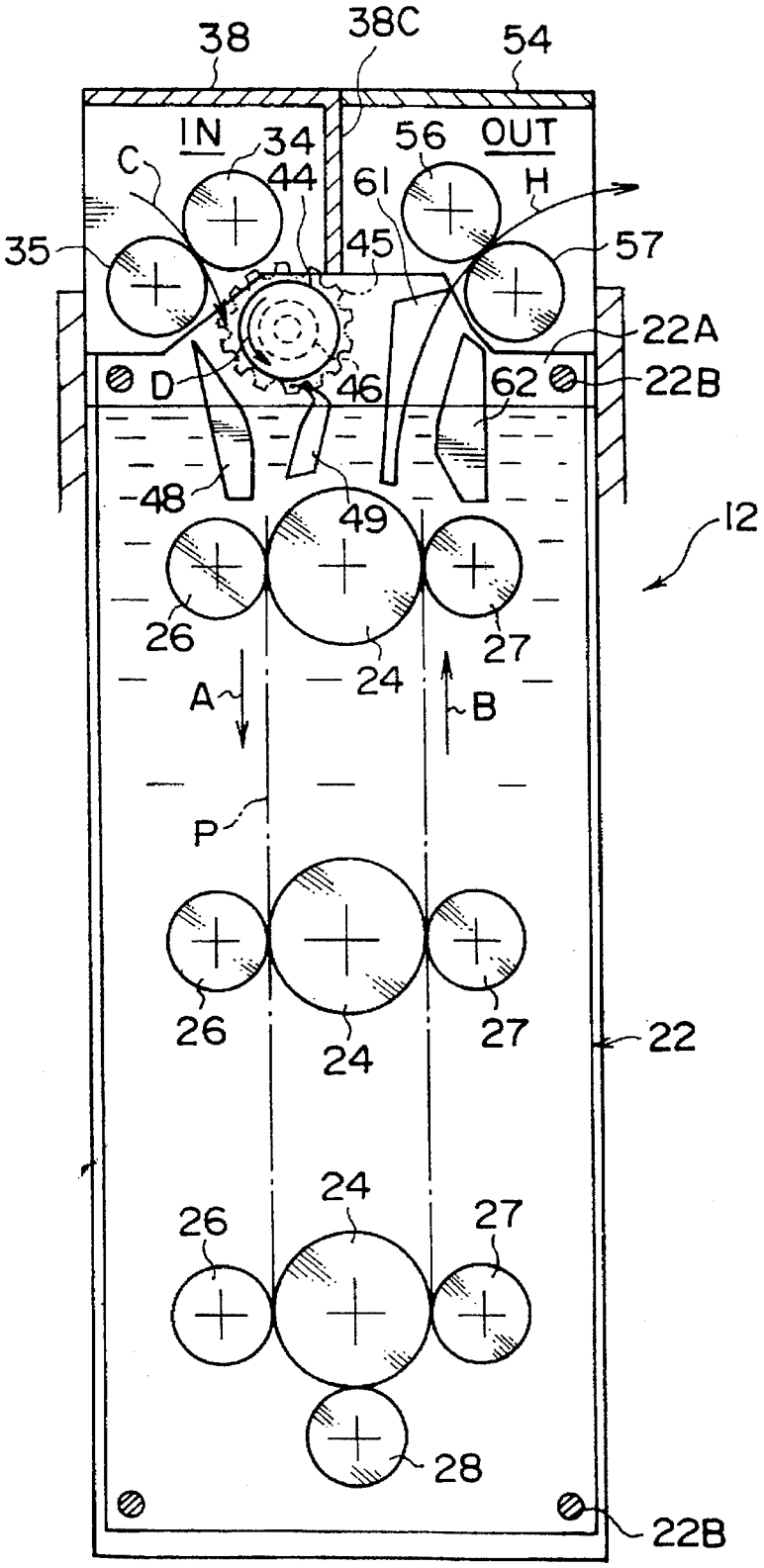
FIG. 1 is a sectional view showing a color developing section of the processing apparatus to which the present invention is applied.
Figure 2A:
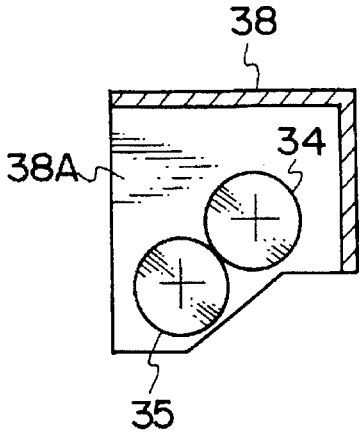
FIG. 2A is a sectional view showing inlet guide rollers which are taken out of the color developing section.
Figure 2B:
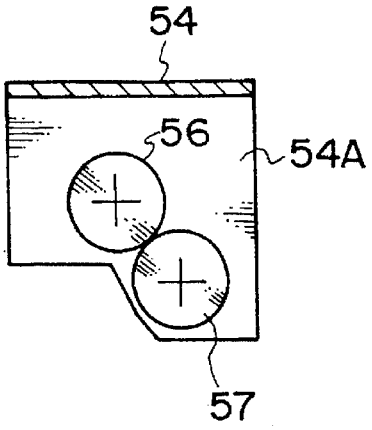
FIG. 2B is a sectional view showing outlet guide rollers which are taken out of the color developing section.
Figure 3:
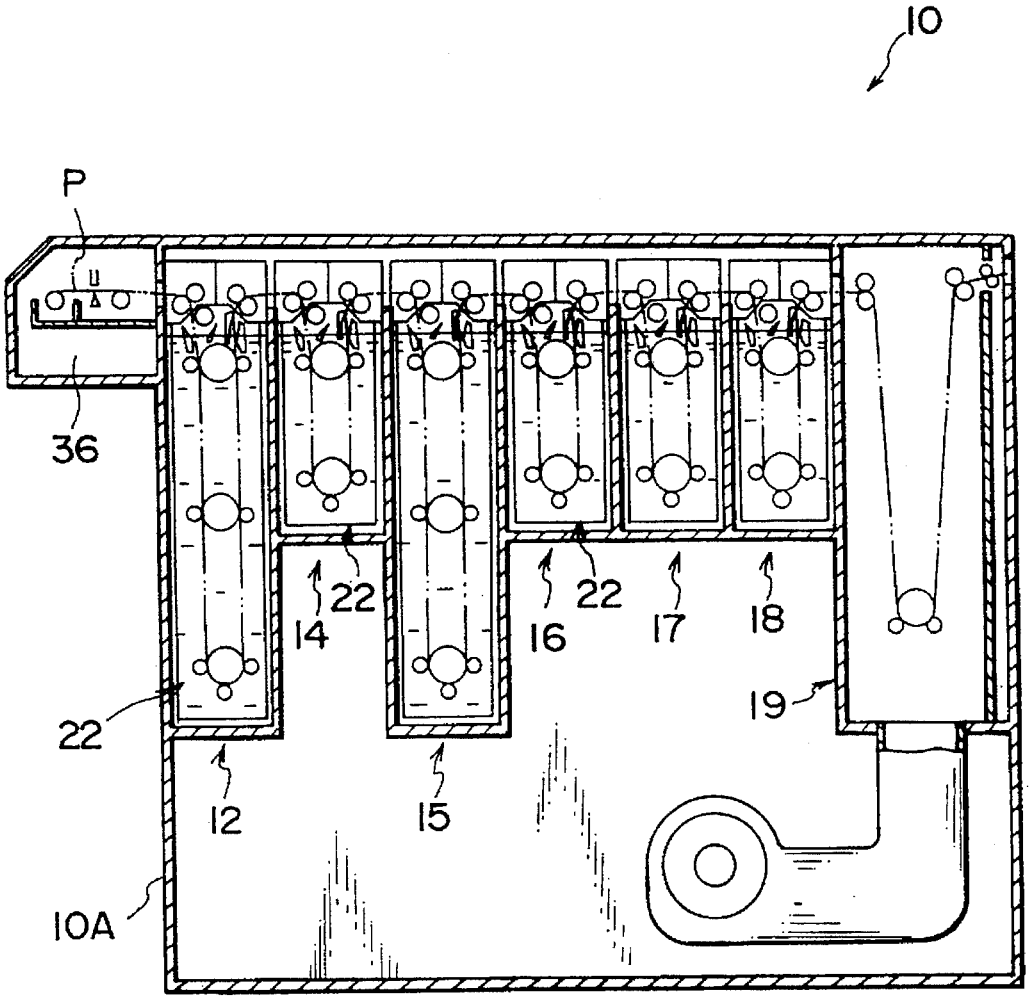
FIG. 3 is a sectional view showing a processing apparatus to which a first embodiment of the present invention is applied.

First Embodiment:

FIG. 3 shows a photosensitive material processing apparatus 10 to which a first embodiment of the present invention is applied. In the photosensitive material processing apparatus 10, various kinds of processing tanks are provided under light-shielded conditions to perform a series of developing processes of a photosensitive material P. In detail, a color developing tank 12, a bleaching tank 14, a bleaching/fixing tank 15, washing tanks 16, 17 and 18, and a drying section 19 are provided from the upstream side to the downstream side such that they are located adjacent to each other. These processing tanks are filled with processing solutions such as a developing solution, a bleaching solution, a bleaching/fixing solution, and water. Transporting racks 22 are disposed in the processing tanks. As shown in FIG. 1 which shows a color developing tank as a representative of the processing tanks, each transport rack 22 comprises a pair of side plates 22A (a side plate on the front side is omitted from the drawing) and a plurality of support rods 22B for connecting the pair of the side plates 22A one to another. Three larger diameter rollers 24 are rotatably supported between the side plates 22A via unillustrated shafts. Further, smaller diameter rollers 26 and 27 are supported between the side plates 22A via unillustrated shafts such that the smaller diameter rollers 26 and the smaller diameter rollers 27 are located on both sides of the larger diameter rollers 24. The photosensitive material P to be immersed into a processing solution is passed between the larger diameter rollers 24 and the small or diameter rollers 26, downwardly transported in the direction of arrow A, then passed between the larger diameter rollers 24 and the smaller diameter rollers 27, and upwardly transported in the direction of arrow B. Moreover, a reversing roller 28 is provided at the lower end of the transport rack 22 to reverse the direction of transportation of the photosensitive material P from the downward direction to the upward direction. The mechanism for supporting the transport rack 22 at the illustrated position in each processing tank is omitted from the drawing. The rollers are rotated by drive force of a motor which is provided outside the processing tank and which serves as a source of drive force. If necessary, guides are provided on both sides of the transport path of the photosensitive material P to restrict the transport direction of the photosensitive material P.

Figure 4:
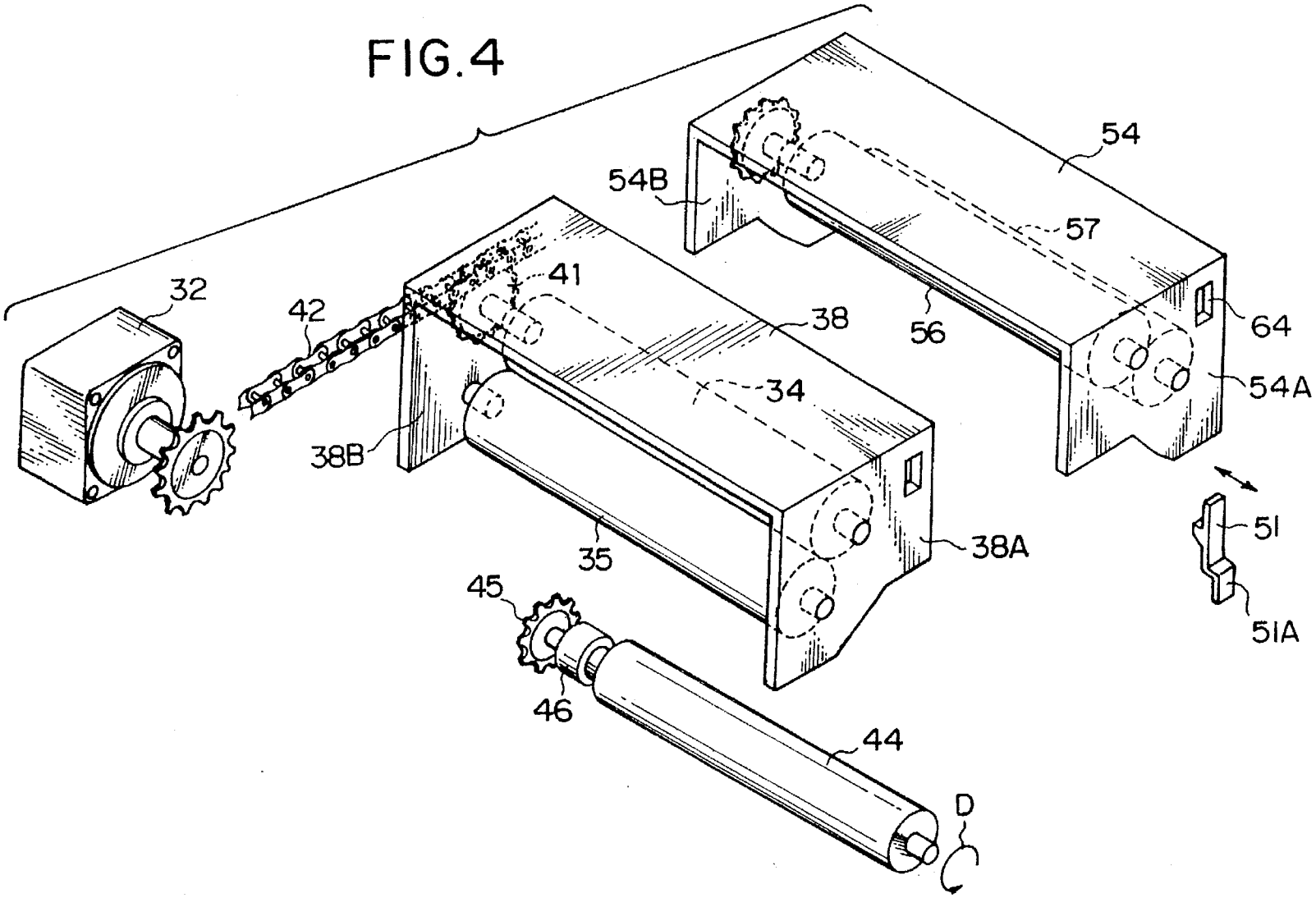
FIG. 4 is a perspective view showing inlet rollers and outlet rollers.

Inlet guide rollers 34 and 35 are rotatably supported in an inlet section IN which is located at the upper left side of the color developing tank 12 in FIG. 1. The inlet guide rollers 24 and 35 nip and guide the photosensitive material P, which is fed from a photosensitive material loading section 36 (see FIG. 3), so that the photosensitive material P is moved downward in the direction of arrow C and is fed into the color developing tank 12. As shown in FIG. 4, both axial ends of the inlet guide rollers 34 and supported by leg plates 38A and 38B of a holding member 38 such that they contact each other. A sprocket wheel 41 is provided at one end of the inlet guide roller 34. Driving force of a motor 32 is transmitted to the sprocket wheel 41 via a chain 42 so as to rotate the inlet guide roller 34. Another leg plate 38C (see FIG. 1) is provided between the leg plates 38A and 38B such that the leg plate 38C is interposed between the inlet section IN and an outlet section OUT.

At the upper portion of the color developing tank 12, another inlet guide roller 44 is rotatably supported by the side plate 22A of the rack 22. The inlet guide roller 44 forms an inlet guide section in corporation with the inlet guide rollers 34 and 35. A sprocket wheel 45 is disposed in coaxial with the inlet guide roller 44, and is engaged with the chain 42 at a position different from the position where the sprocket wheel 41 is engaged with the chain 42. The inlet guide roller 44 receives drive force of the motor 32 and rotates so as to guide the tip portion and one side surface of the photosensitive material P fed by the inlet guide rollers 34 and 35 and feed the photosensitive material P downward in a generally vertical direction into the color developing tank 12. A one-way clutch 46 is provided between the sprocket wheel 45 and the inlet guide roller 44. Therefore, driving force of the chain is transmitted to the inlet guide roller 44, but the inlet guide roller 44 is allowed to independently and freely rotate in the counterclockwise direction (the direction of arrow D) in FIG. 1 when the motor 32 is stopped. Accordingly, the inlet guide roller 44 can be freely rotated for maintenance work such as cleaning and checking even when other rollers are stopped.

Figure 5:
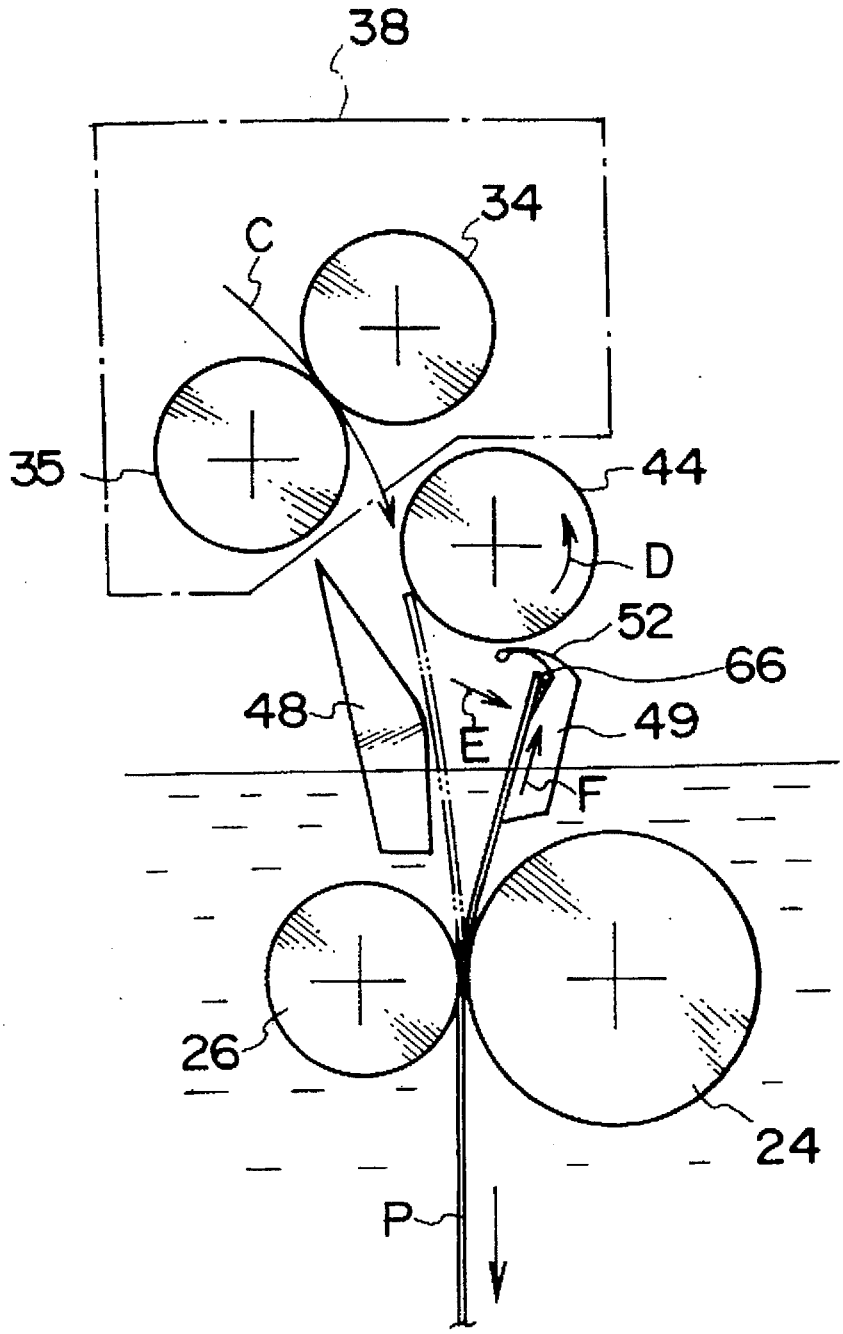
FIG. 5 is an enlarged sectional view showing the inlet portion.

Under the inlet guide roller 44, a pair of stationary guides 48 and 49 are fixedly attached to the transport rack 22. The stationary guides 48 and 49 extend in the vertical direction along a wall surface of the color developing tank 12 so as to properly guide the photosensitive material P into the color developing tank 12. The gap between the stationary guides 48 and 49 gradually increases toward the upper end of the gap. The stationary guide 49 is disposed just under the inlet guide roller 44. As shown in FIG. 5, an extension arm 52 serving as an adhesion preventing member is extended from the stationary guide 49. The extension arm 52 is extended from the upper end of the stationary guide 49 and forms an arcuate shape, so that the tip of the extension arm 52 is directed toward the stationary guide 48. Accordingly, the stationary guide 49 forms a generally L-shaped overall configuration together with the extension arm 52, and the extension arm 52 is interposed between the inlet guide roller 44 and the surface of the processing solution on the side of the stationary guide 49 which side faces the transport path of the photosensitive material P (i.e., faces the stationary guide 48). Accordingly, when the tail end of the photosensitive material P which is fed as shown by an imaginary line in FIG. 5 disengages from the inlet guide roller 44, the tail end of the photosensitive material P contacts the stationary guide 49 as indicated by arrow E due to the impetus of the photosensitive material P returning to a straight state. In such a case, the tail end of the photosensitive material P gets in under the extension arm 52. The photosensitive material P is fed into the color developing tank 12 such that the side surface having an emulsion layer faces the stationary guide 49.

When the tail end of the photosensitive material P contacts the stationary guide 49, as shown in FIG. 5, the developing solution adhering to the surface of the stationary guide 49 is squeezed by the photosensitive material P and the stationary guide 49, and is moved upward. However, since the developing solution thus squeezed out is blocked by the extension arm 52, it does not reach the inlet guide roller 44. To obtain this effect, it is sufficient for the extension portion 52 to exist in the direction of the rear end (the direction of arrow F) of the stationary guide 49 or the photosensitive material P which contacts the stationary guide 49.

At the outlet section of the color developing tank 12, which is located above arrow B shown in FIG. 1, a pair of outlet guide rollers 56 and 57 are rotatably supported by leg plates 54A and 54B of a holding member 54, and form an outlet guide section. These outlet guide rollers 56 and 57 receive the photosensitive material P which is transported upward in the direction of the arrow B and taken out of the color developing tank 12, and transports the photosensitive material P in the direction of arrow H so as to feed it out to the inlet section of the succeeding fixing/bleaching tank 14. Like the inlet guide rollers 34, the outlet guide rollers 56 and 57 receive the drive force of the chain 42 via a sprocket wheel to rotate. Beneath these outlet guide rollers 56 and 57, stationary guides 61 and 62 are disposed to guide the photosensitive material P, which is fed in the direction of arrow B such that the photosensitive material P passes between the outlet guide rollers 56 and 57.

The holding members 38 and 54 are fixed to the upper portion of the color developing tank 12 by placing them on the transport rack 22, or causing clips 51 serving as a fixture to engage with openings 64 formed in the leg plates 38A and 54A. The lower ends 51A of the clips 51 are fixed to a body 10A of the photosensitive material processing apparatus 12 or the transport rack 22, and the upper portions of the clips 51 are deformable in the direction of the arrow shown in FIG. 4. Accordingly, the holding members 38 and 54 can individually be removed from the transport rack 22 by releasing the engagement with the clips 51 or the like. The fixtures for the holding members 38 and 54 are not limited to the above-described clips 51, and various types of structures can be used for the fixtures.

An inlet section and an outlet section similar to the holding members 38 and 54 are provided at the upper portion of each of the fixing/bleating tank 14 and the following processing tanks to guide the photosensitive material P.

Next, operation of the above-described first embodiment will be described.

The photosensitive material P, for example, a rolled film, on which photographed images are formed by exposure, is loaded into the photosensitive material loading section 36 of the photosensitive material processing apparatus 10. The photosensitive material P is then fed into the color development tank 12 through its inlet section. The photosensitive material P fed in the direction of arrow C is nipped and transported by the inlet guide rollers 34 and 35, so that the photosensitive material P contacts the inlet guide roller 44 and then enters the developing solution in the color developing tank 12. Before the tail end of the photosensitive material P disengages from the inlet guide roller 44 as shown in FIG. 5, the leading end of the photosensitive material P has already been transported in the direction of arrow A and nipped by the larger diameter rollers 24 and the smaller diameter rollers 26. Accordingly, when the tail end of the photosensitive material P disengages from the inlet guide roller 44, the tail end of the photosensitive material P starts to return to a straight state due to its elasticity. In some cases, the tall end does not stop at the straight state but bends in the opposite direction so that the end portion hits the stationary guide 49. If the developing solution in the color developing tank 12 is present on the surface of the stationary guide 49 on this occasion, the developing solution on the stationary guide 49 is squeezed by the photosensitive material P and the stationary guide 49, so that it splashes upward (in the direction of arrow F) as a splash solution 66. However, since the splash solution 66 is caught by the extension arm 52, the splash solution 66 does not reach the inlet guide rollers 34 and 35. Accordingly, the inlet guide rollers 34 and 35 do not cause the problem that a subsequent photosensitive material P contacts the splash solution 68 which would otherwise adhere to the inlet guide rollers 34 and 35. Therefore, it is possible to prevent the occurrence of unevenness in development which is caused by adhesion of the developing solution to the photosensitive material P before the photosensitive material enters the color developing tank 12.

The photosensitive material P transported in the direction of A by the larger diameter rollers 24 and the smaller diameter rollers 26 is reversed by the reversing roller 28, and is upwardly transported by the larger diameter rollers 24 and the smaller diameter rollers 27 so that it moves in the direction of arrow B to leave the development solution. Subsequently, the photosensitive material is nipped and transported by the outlet rollers 56 and 57 in the outlet section so that it moves in the direction of arrow It. After that, the photosensitive material P is subjected to a series of processes in the succeeding processing tanks such as the fixing/bleaching tank 14. The photosensitive material P is taken out after being dried at the drying section 19.

When cleaning and maintenance are performed after the processing operation, the inlet guide rollers 34 and 35 and the outlet guide rollers 56 and 57 are removed for washing with water, and the like work. Since the holding member 38 and the holding member 54 can individually be removed in the present embodiment, the development solution does not flow and adhere to the inlet guide rollers, which would occur the case where the holding member 38 and the holding member 54 are integrated. That is, when these holding members 38 and 54 are integrated, the developing solution flows along or drips from the outlet guide rollers 56 and 57 and reaches the inlet guide rollers 34 and 35 depending on the orientation of the holding members 38 and 54 when the holding members 38 and 54 are removed or cleaned. In the present embodiment, since the holding member 38 and the holding member 54 can individually be removed, adhesion of the development to the inlet guide rollers 34 and 35 can be prevented.

To remove the holding members 38 and 54, the transport rack 22 is taken out of the color developing tank 12 with the holding members 38 and 54, and thereafter the holding members 38 and 54 are removed from the transport rack 22. Alternatively, the holding members 38 and 54 are removed from the transport rack 22 which is left in the color developing tank 12. In either case, adhesion of the development to the inlet guide rollers 34 and 35 can be prevented.

The problem that the developing solution adhering to the outlet guide rollers 56 and 57 drips onto the inlet guide rollers 34 and 35 can be prevented by employing a structure in which one of the holding members 38 and 54 is fixedly attached to the transport rack 22 while the other of the holding members 38 and 54 is removably attached to the transport rack 22. In the case where a structure is employed in which only the holding member 54 is removably attached to the transport rack 22 and the inlet guide rollers 34 and 35 of the holding member 38 are not soiled, the holding member 38 can be integrated with the transport rack 22.

In addition, it is possible to clean the inlet guide roller 44 while rotating it, after the removal of the holding members 38 and 54. Since the inlet guide roller 44 can independently be rotated due to the presence of the one-way clutch 46 even when the motor 32 is stopped, cleaning can be performed easily and securely.

When cleaning is performed of an entire outer surface of a roller such as the inlet guide roller 44 which is connected to a motor through a drive train, the roller must be cleaned while rotating the roller, because guides and other structural components present around the roller may obstruct the cleaning. In such a case, the following methods are conventionally used.

(a) An operator stops the motor, and attaches a handle to a shaft connected to the output shaft of the motor. After that, while manually rotating the handle, the operator applies a cleaning solution to the roller and then wipes the roller with cloth.

(b) An operator removes a rack in which a roller to be cleaned is built and disengages the roller from the drive train connected to the motor. After that, the operator applies a cleaning solution to the roller and then wipes the roller with cloth.

In the method (a), as the operator must manually rotate all the rollers which should be driven by the motor a large force is needed. In the method (b), it is required to take out the entire rack and to rotate all the rollers on the rack. Therefore, a large force is required, and a processing solution splashes around the processing apparatus when the rack is taken out.

In contrast, the above-described present invention in which one-way clutches are used provides a photosensitive material processing apparatus which makes it possible to easily clean rollers, which are normally driven by a motor, without using a special tool. That is, the use of the one-way clutches makes it possible to manually rotate only a roller to be cleaned. This eliminates a large force in rotating the roller and makes it possible to easily clean the entire outer surface of the roller. Accordingly, it is possible to always maintain specific rollers cleaned, so that the photosensitive material can be processed without producing unevenness in the quality.

Second Embodiment:

A second embodiment of the present invention will be described with reference to FIG. 6 and FIG. 7.

In the present embodiment, the holding members 38 and 54 used in the first embodiment are integrated to form a single holding member 71. In this holding member 71, a partition member 72 is disposed between an inlet section IN and an outlet section OUT to separate the inlet section IN from the outlet section OUT. The partition member 72 allows the inlet section IN and outlet section OUT to communicate with each other only through a gap formed between the lower end 72A of the partition member 72 and the surface 12B of a processing solution. The lower end 72A projects toward the processing tank (downwardly in a mounted state) from a straight line K connecting the lowermost portion of the inlet guide rollers 34 and 35 forming an inlet guide section and the lowermost portion of the outlet guide rollers 56 and 57 forming an outlet guide section. Further, the lower end 72A is prevented from being immersed into the processing solution held in the processing tank. Thus, the partition member 72 serves as a dripping preventing device. Accordingly, when the holding member 71 is taken out of the photosensitive material processing apparatus 10 and its orientation is changed (in this case, the holding member 71 is turned by 90° in the counterclockwise direction), as shown in FIG. 7, for cleaning, checking, etc., the developing solution adhering to the outlet guide rollers 56 and 57 drips as a dripping solution 73. However, since the dripping solution 73 is received by the partition member 72, the dripping solution 73 does not reach the inlet guide rollers 34 and 35. The lower end portion 72A is provided with a small projection 72B which projects toward the outlet section OUT. The small projection 72B prevents the dripped developing solution from flowing along the lower end portion 72A and reaching the inlet section.

Third Embodiment:

A third embodiment of the present invention will be described with reference to FIG. 8 and FIG. 9.

Figure 8:
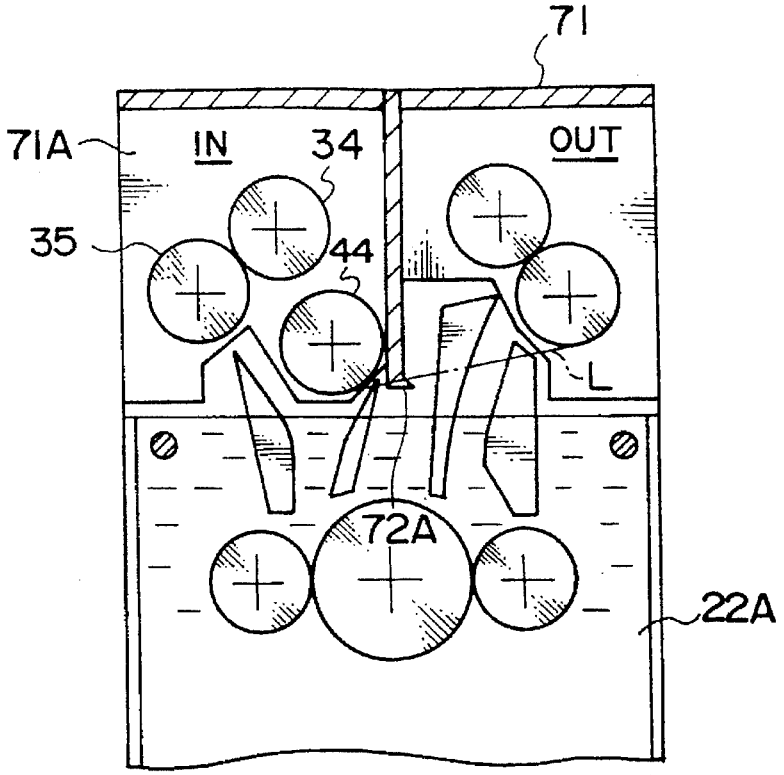
FIG. 8 is a sectional view of a color developing section showing a third embodiment of the present invention.
Figure 9:
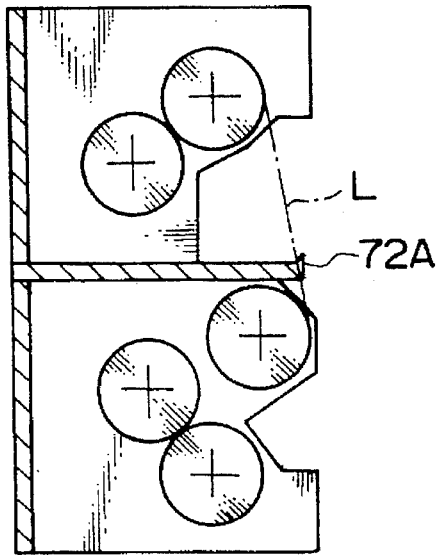
FIG. 9 is a sectional view showing the holding member which is taken out of the color developing section shown in FIG. 8.

In this embodiment, the inlet guide roller 44 is rotatably supported by a pair of leg plates 71A of the holding member 71, as shown in FIG. 8. In FIGS. 8 and 9, one sides of the leg plates 71A are not shown. In this case, the inlet guide roller 44 is also removed together with the holding member 71 for cleaning, checking, etc. Therefore, the developing solution which is dripped from the outlet guide rollers 56 and 57 due to changes in the orientation of the holding member 71 as shown in FIG. 9 may adhere to the inlet guide roller 44. In the present embodiment, the lowermost portion of the inlet guide section is the lower portion of the inlet guide roller 44 which faces the developing solution. Accordingly, the lower end 72A of the partition member 72 projects toward the processing tank from a straight line L connecting the lowermost portion of the inlet guide roller 44 and the lowermost portion of the outlet guide roller 56, and is prevented from being immersed into the processing solution stored in the processing tank.

Figure 10:
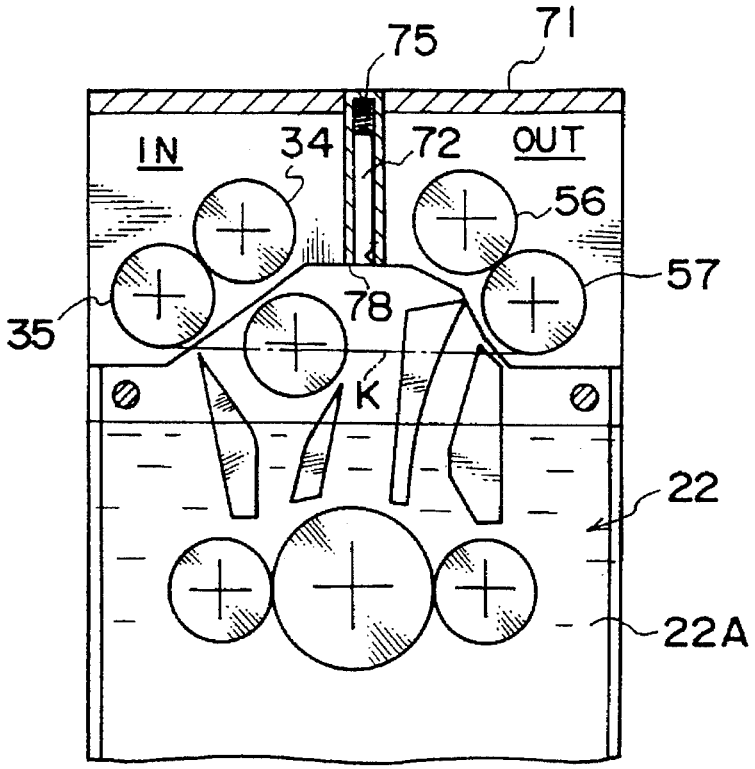
FIG. 10 is a sectional view of a color developing section showing a fourth embodiment of the present invention.
Figure 11:
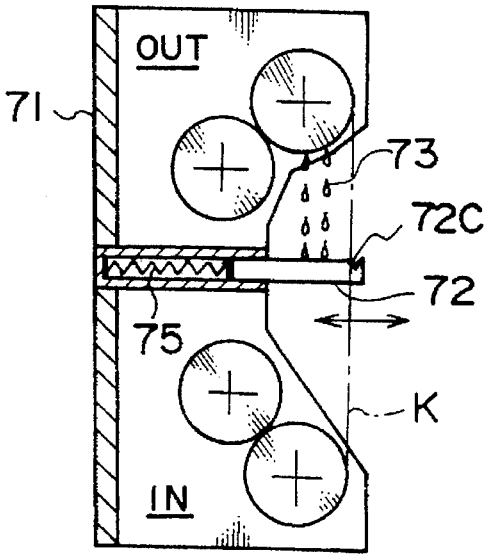
FIG. 11 is a sectional view showing the holding member which is taken out of the color developing section shown in FIG. 10.

Fourth Embodiment:

A fourth embodiment of the present invention will be described with reference to FIG. 10 and FIG. 11.

Figure 6:
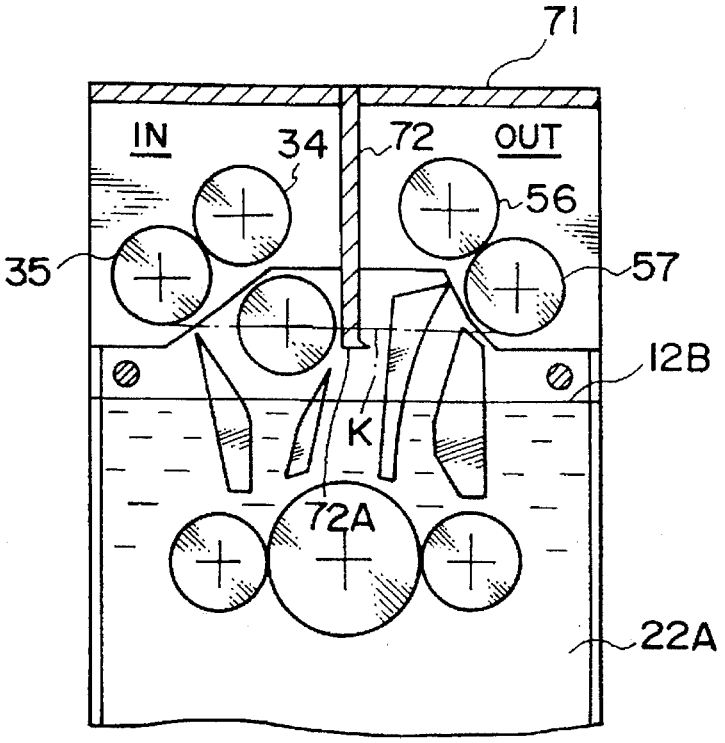
FIG. 6 is a sectional view of a color developing section showing a second embodiment of the present invention.

As in the second embodiment shown in FIG. 6, inlet guide rollers 84 and 35 and outlet guide rollers 56 and 57 are rotatably supported by the single holding member 71. However, the partition member 72 is short, and does not project between the inlet guide roller 35 and the outlet guide roller 57 but is retracted into a tubular guide 78 when the holding member 71 is attached to the developing tank 12, as shown in FIG. 10. That is, a compression coil spring 75 is disposed between the partition member 72 and the holding member 71 to urge the partition member 72 to project between the inlet guide roller 35 and the outlet guide roller 57. However, when the holding member 71 is mounted on the color developing tank 12, the tip portion of the partition member 72 contacts the transport rack and is pushed into the tubular guide 78. When the holding member 71 is removed from the color developing tank 12, the tip portion of the partition member 72 projects from the tubular guide 78 due to an urging force of the compression coil spring 75, so that the partition member 72 is disposed between the inlet guide roller 35 and the outlet guide roller 57 to receive dripping developing solution 73 in the same manner as in the second embodiment shown in FIG. 6 and FIG. 7.

The partition member 72 of the present invention is provided with a groove 72C formed at the forward end thereof. This groove 72C stores the dripped developing solution, thereby preventing it from flowing toward the inlet section IN.

Figure 12:
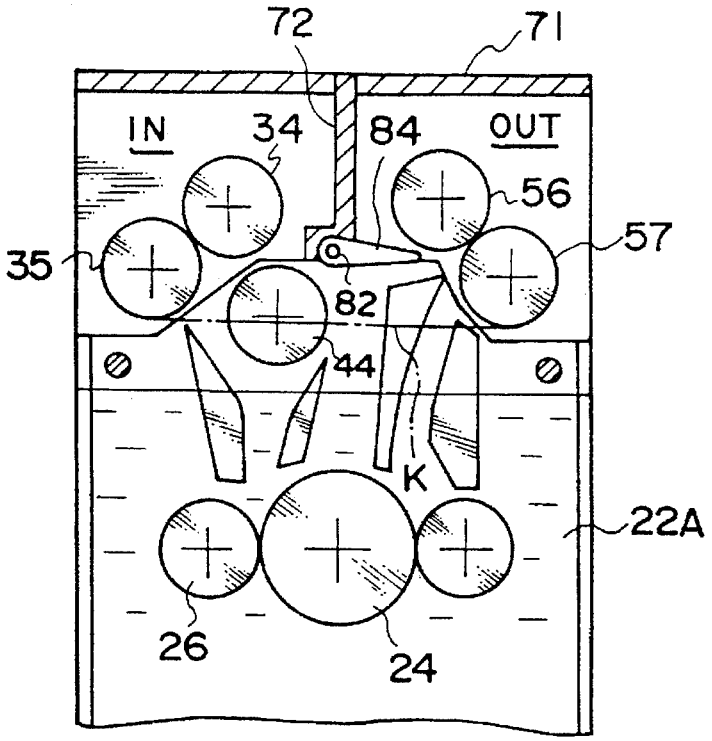
FIG. 12 is a sectional view of a color developing section showing a fifth embodiment of the present invention.
Figure 13:
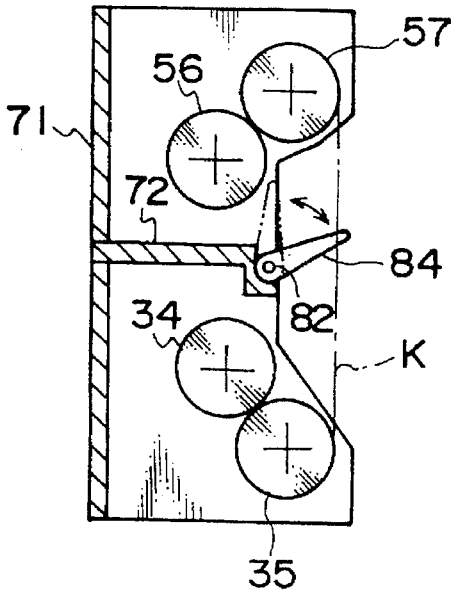
FIG. 13 is a sectional view showing the holding member which is taken out of the color developing section shown in FIG. 12.

Fifth Embodiment:

A fifth embodiment of the present invention will be described with reference to FIG. 12 and FIG. 13.

In this embodiment, the partition member 72 is fixed to the holding member 71, and has a length which does not reach the space between the inlet guide roller 35 and the outlet guide roller 57.

However, in the present embodiment, a swingable partition member 84 is supported at the forward end of the partition member 72 via a shaft 82. When the holding member 71 is attached to a transport rack 22 as shown In FIG. 12, the swingable partition member 84 hits the upper end of a side plate 22A of the transport rack 22 and rotates around the shaft 82 in the counterclockwise direction, so that it approaches the outlet guide roller 57, i.e., becomes horizontal. However, when the holding member 71 is removed from the transport rack 22 and its orientation is changed as shown in FIG. 13, the swingable partition member 84 rotates about the shaft 82 in the clockwise direction due to its own weight, and stops at the position shown in FIG. 13. As a result, the tip portion of the swingable partition member 84 projects toward the processing tank from a straight line K connecting the lowermost portion of the inlet guide roller 35 and the lowermost portion of the outlet guide roller 57 so as to catch the developing solution dripped from the outlet guide roller 57. An elastic member such as a spring may be provided to urge the swingable partition member 84 to rotate in the clockwise direction or the counterclockwise direction. Further, a fixing mechanism such as a pressing spring may be provided to temporarily fix the swingable partition member 84 at the projected position shown in FIG. 13. Other than this embodiment, various variations off the swingable partition member can be applied to the holding member.

Figure 14:
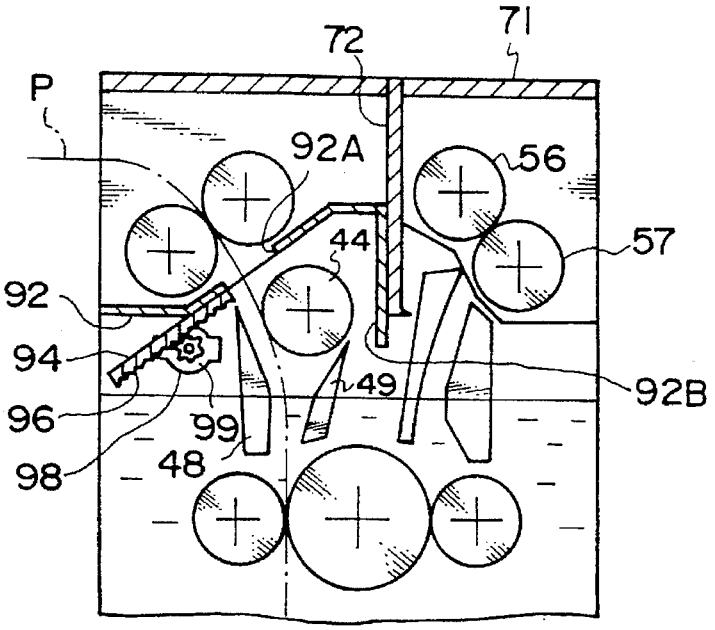
FIG. 14 is a sectional view of a color developing section showing a sixth embodiment of the present invention.

Sixth Embodiment:

A sixth embodiment of the present invention will be described with reference to FIG. 14 and FIG. 15.

Figure 7:
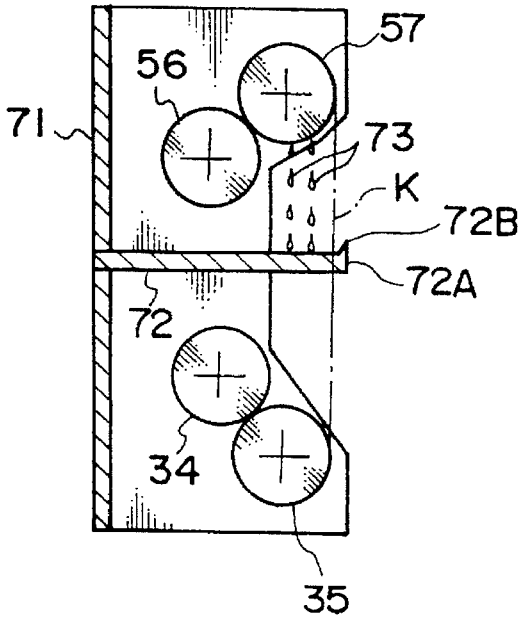
FIG. 7 is a sectional view showing the holding member which is taken out of the color developing section shown in FIG. 6.

In this embodiment, the holding member 71 has the same structure as in the second embodiment shown in FIG. 6 and FIG. 7 except that a partition member is provided on the color developing tank 12 as a dripping preventing apparatus.

In detail, a stationary partition member 92 is disposed on a side plate 22A of the transport rack 22 of the color developing tank 12. The stationary partition member 92 is located above the stationary guides 48 and 49 provided in the inlet section of the color developing tank 12, and the inlet guide roller 44. A photosensitive material P passes through a window 92A formed in the stationary partition member 92. In the stationary partition member 92, one end adjacent to the outlet section is downwardly bent to form a skirt portion 92B which isolates the inlet guide roller 44 from the outlet section. The position of the skirt portion 92B is determined such that it overlaps the partition member 72 of the holding member 71 when the holding member 71 is placed on the transport rack 22, as shown in FIG. 14. The window 92A of the stationary partition member 92 can be closed by a movable partition member 94. A rack 96 is fixed to the movable partition member 94 and is meshed with a pinion 99 driven by a motor 98. Accordingly, the window 92A of the stationary partition member 92 can be closed and opened by the movable partition member 94 which is driven by the rotation of the motor 98 in forward and reverse directions. The motor 98 is controlled by a control apparatus in such a manner that when a photosensitive material passes through the window 92A, the movable partition member 94 is retracted from the window 92A, and that when no photosensitive material is passes, the window 92A is closed.

Figure 15:
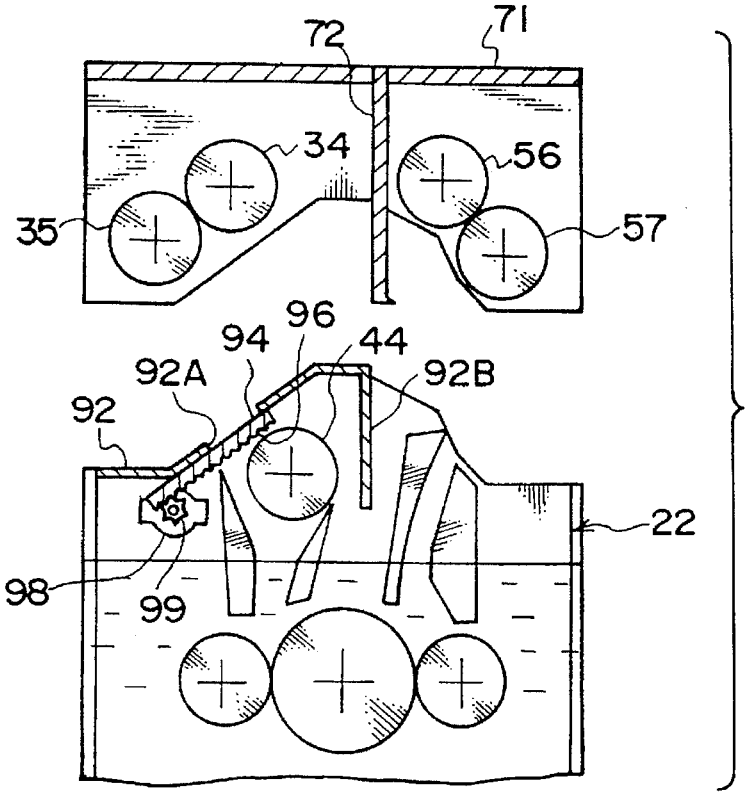
FIG. 15 is a sectional view showing the holding member which is taken out of the color developing section shown in FIG. 14.

As a result, even when the holding member 71 is taken out for cleaning and checking, as shown in FIG. 15, the developing solution adhering to the outlet guide roller 56 and 57 does not drip on the inlet guide roller 44 which is a part of the inlet guide section, because the window 92A is closed by the movable partition member 94. The present embodiment may be modified such that removal of the holding member 71 is detected by a sensor or the like to drive the motor 98, thereby closing the window 92A.

Figure 16:
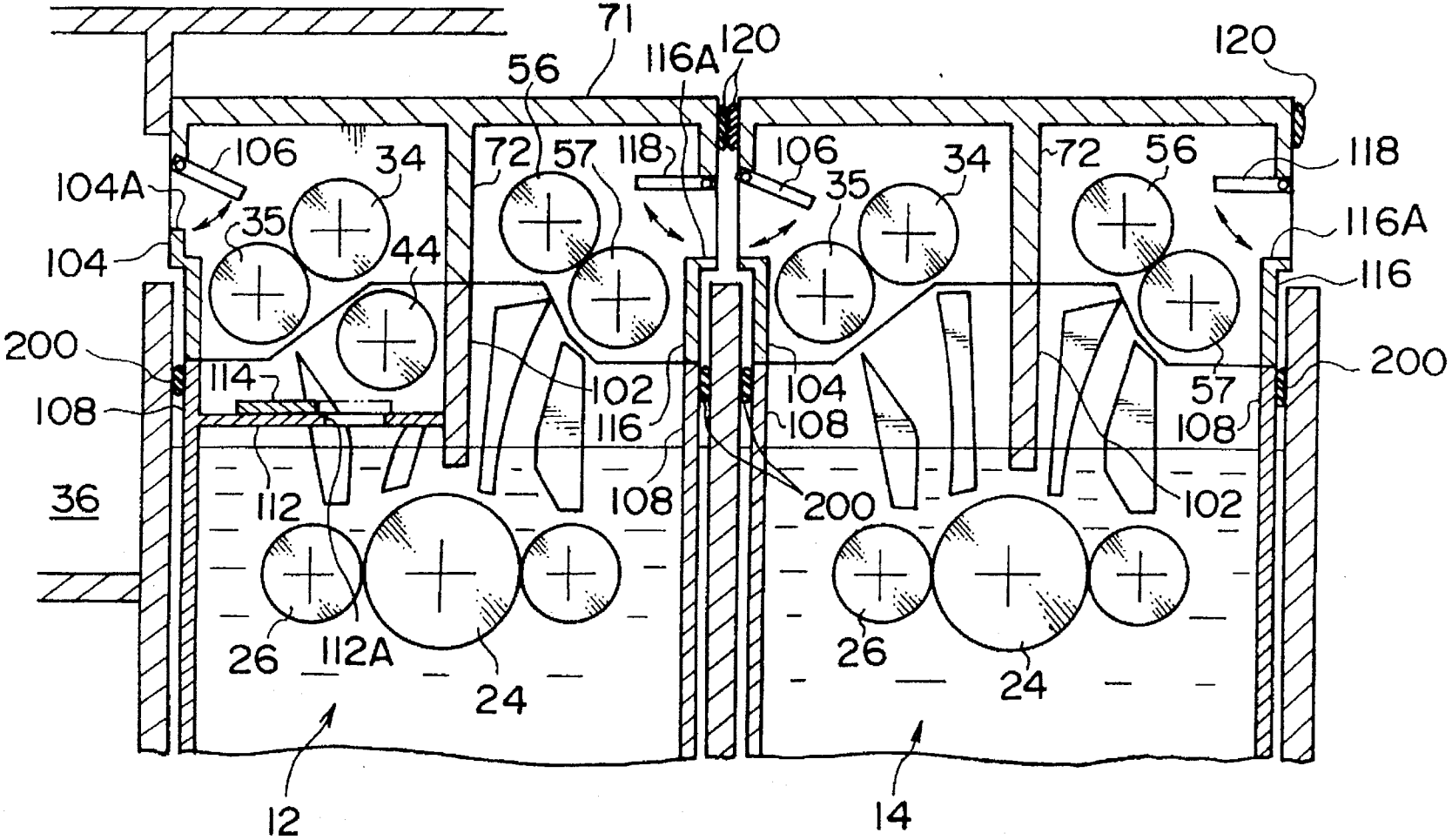
FIG. 16 is a sectional view showing a seventh embodiment of the present invention.

Seventh Embodiment:

Next, a seventh embodiment of the present invention will be described with reference to FIG. 16.

In this embodiment, a stationary wall 102 is vertically disposed at the central portion of the color developing tan 12 above the larger diameter roller 24, and the partition member 72 of the holding member 71 is in contact with the upper end of the stationary wall 102. Further, a stationary partition member 104 is attached to the holding member 71. The stationary partition member 104 separates the upstream photosensitive material loading section 36 from the inlet section of the color developing tank 12. Moreover, a packing 200 is at the outer circumference of vertical walls 108 and the side plates 22A above the surface of the developing solution in order to shield the inlet section from the outside. A window 104A is formed in the stationary partition member 104, and is opened and closed by a door member 106.

Accordingly, when the window 104A is closed by the door member 106, the inlet section of the color developing tank 12 is isolated from the outside air.

The stationary partition member 104 is in contact with the upper end of a vertical wall 108, which is formed as a part of the transport track 22 of the color developing tank 12. Also, a horizontal wall 112 extends between the vertical wall 108 and the stationary wall 102. A window 112A through which the photosensitive material P passes is formed in the horizontal wall 112, and is opened and closed by a door member 114.

In the outlet section of the color developing tank 12, a stationary partition member 116 which is fixed to part of the holding member 71 extends downwardly and contacts the upper end of the vertical wall 108, so that the outlet section is shield from the outside. A window 116A formed in the stationary partition member 116 is provided with a door member 118 which can be opened when the photosensitive material P passes therethrough. The remaining processing tanks such as the fixing/bleaching tank 14 disposed on the downstream side of the color developing tank 12 have the same structure as the color developing tank 12 except for the horizontal wall 112. A packing is disposed between adjacent two processing tanks. For example, a packing 120 is held between the holding member 71 of the color developing tank 12 and the holding member 71 of the fixing/bleaching tank 14, thereby shielding the space therebetween from the outside.

Drive forces from motors are transmitted to the door members 106, 114 and 118 via drive trains similar to those for the movable partition member 94 in the previous embodiment, so that the door members are opened when the photosensitive material passes through, anal are closed when no photosensitive material passes through.

In this embodiment having the above-described structure, the outlet section of each processing tank is isolated from the outside air by the stationary partition member 116, the door member 118 and the packing 200, thereby preventing the processing solution from evaporating and escaping. Also, the inlet section off each processing tank is isolated from the outside air by the stationary partition member 104, the door member 106 and the packing 200, thereby preventing the evaporated processing solution from entering into the inlet section. Moreover, since the inlet section of the color developing tank 12 is isolated from the surface of the color developing solution by the partition member 72, the horizontal wall 112, the door member 114 and the packing 200, an evaporated processing solution can be prevented from adhering to the inlet guide rollers 34, 35 and 44 and condensing thereon. This also prevents the developing solution from adhering to the rollers in the inlet section, so as not to cause unevenness in development.

Figure 17:
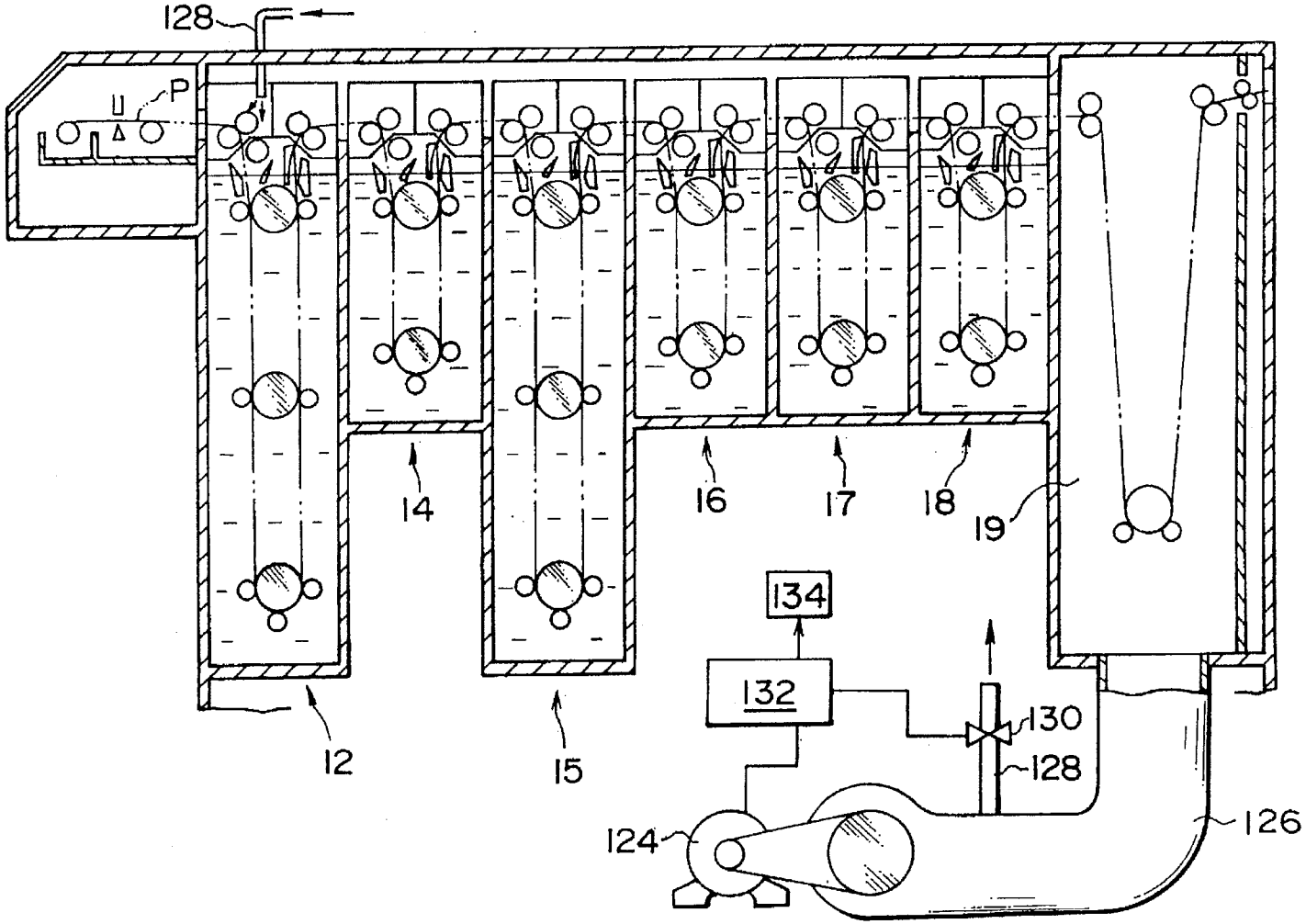
FIG. 17 is a sectional view showing an eighth embodiment of the present invention.

Eighth Embodiment:

Next, an eighth embodiment of the present invention will be described with reference to FIG. 17.

In this embodiment, the operation of a motor 124 for supplying a drying air to the dying section 19 via a drying air duct 126 and the opening of an open/close valve 130 provided in a branch pipe 128 of the duct 126 are controlled by a control apparatus 132. The branched drying air is supplied to the inlet section of the color developing tank 12 to dry the inlet guide rollers 34, 35 and 44, thereby preventing the developing solution from adhering to a photosensitive material P even when the photosensitive material P contacts their rollers.

A sensor for detecting the temperature of a processing solution and a sensor for detecting the room temperature are connected to the control apparatus 132, which controls the motor 32 for transporting the photosensitive material P. While processing solutions such as the developing solution are heated to a predetermined temperature (for example, 38° C.) by an unillustrated heater or heaters at the start-up of the photosensitive material processing apparatus 10, the inlet guide section is heated and dried by the branched drying air from the branch pipe 128. The period of time for drying is determined based on the outside temperature, i.e., the room temperature before using the processing apparatus. That is, the lower the room temperature, the longer the period of time during which the air is supplied. The higher the room temperature, the shorter the period of time during which the air is supplied. Also, such a control is performed based on the lowest temperature during a predetermined period of time (for example, 24 hours) before use. Namely, the lower the lowest temperature, the longer the period for supplying the drying air, while the higher the lowest temperature, the shorter the period for supplying the drying air. The processing of photosensitive materials are prohibited until the longer of the above-described drying time and the time required to heat the processing solutions has elapsed. The prohibition of processing is displayed on displaying means 134 such as a liquid crystal display or a CRT display while the inlet section is closed and/or the rotation of the transport rollers is stopped.

The branch pipe 128 may be led to processing tanks other than the color developing tank 12 to dry rollers in a similar manner. Also, a heater or the like may be provided instead of branching the drying air from the drying section 19.

Various structures have been described in the above-described embodiment while referring only to the color developing tank. However, these structures can also be applied to other processing tanks such as a bleaching tank.

Since the present invention has the above-described structure, it is possible to prevent photosensitive materials from being unevenly processed.

While the embodiments of the present invention as herein disclosed constitute a preferred from, it is to be understood that other forms might be adopted.

What is claimed is:

1. A photosensitive material processing apparatus in which a transport rack is provided and a photosensitive material is immersed into a processing tank filled with a processing solution such as a developing solution for processing said photosensitive material, said apparatus comprising:

an inlet guide section provided at an inlet section of said processing tank and adapted to contact said photosensitive material before immersion to feed said photosensitive material into said processing tank, said inlet guide section being removably provided on an upper portion of said transport rack; and an outlet guide section provided at an outlet section of said processing tank and adapted to contact said photosensitive material after immersion to feed out said photosensitive material from said processing tank, said outlet guide section being provided on the upper portion said transport rack such that said outlet guide section is removable from said transport rack independent of said inlet guide section.

2. A photosensitive material processing apparatus according to claim 1, wherein said inlet guide section is held by a first holding member while said outlet guide section is held by a second holding member, and said first holding member and said second holding member are independently placed on the upper portion of said transport rack, whereby said inlet guide section and said outlet guide section are removably provided on the upper portion of said transport rack.

3. A photosensitive material processing apparatus according to claim 1, wherein said inlet guide section is held by a first holding member while said outlet guide section is held by a second holding member, said first and second holding members are respectively provided with openings, and said first holding member and said second holding member are independently fixed on the upper portion of said transport rack in a state in which two fixing members fixed to said processing tank or said transport rack are engaged with said respective openings, whereby said inlet guide section and said outlet guide section are removably provided on the upper portion of said transport rack.

4. A photosensitive material processing apparatus in which a transport rack is provided and a photosensitive material is immersed into a processing tank filled with a processing solution such as a developing solution for processing said photosensitive material, said apparatus comprising:

an inlet guide section provided at an inlet section of said processing tank and adapted to contact said photosensitive material before immersion to feed said photosensitive material into said processing tank;

an outlet guide section provided at an outlet section of said processing tank and adapted to contact said photosensitive material after immersion to feed out said photosensitive material;

a holding member for holding said inlet guide section and said outlet guide section together, and removable from said transport rack; and a dripping preventing device for preventing the processing solution adhering to said outlet guide section from dripping onto said inlet guide section in a state in which said holding member is removed from said transport rack.

5. A photosensitive material processing apparatus according to claim 4, wherein said dripping preventing device is a partition member the tip portion of which projects toward said processing tank from a straight line connecting a lowermost portion of said inlet guide section which faces said processing tank, and a lowermost portion of said outlet guide section which faces said processing tank.

6. A photosensitive material processing apparatus according to claim 5, wherein said tip portion is provided with a small projection which projects toward said outlet guide section to prevent said processing solution from reaching said inlet guide section side from said outlet guide section side.

7. A photosensitive material processing apparatus according to claim 4, wherein said dripping preventing device comprises a guide, a partition member movable along said guide, and a coil spring for urging said partition member to project from said guide, and wherein when said holding member is attached to said transport rack, the tip portion of said partition member contacts said transport rack so that said partition member is retracted along said guide, and when said holding member is removed from said transport rack, said partition member projects along said guide by the urging force of said coil spring so that said partition member is interposed between said outlet guide section and said inlet guide section.

8. A photosensitive material processing apparatus according to claim 7, wherein said tip portion of said partition member is provided with a groove which is formed in a side surface facing said outlet guide section to prevent said processing solution from reaching said inlet guide section side from said outlet guide section side.

9. A photosensitive material processing apparatus according to claim 4, wherein said dripping preventing device comprises a partition member, and a swingable partition member which is rotatably supported in the vicinity of a tip portion of said partition member via a shaft, and wherein when said holding member is attached to said transport rack, said swingable partition member contacts an upper end of said transport rack so that said swingable partition member becomes horizontal, and when said holding member is removed from said transport rack, said swingable partition member rotates so that a tip portion of said swingable partition member is interposed between said outlet guide section and said inlet guide section.

10. A photosensitive material processing apparatus according to claim 4, wherein, in case that a part of said inlet guide section is directly held by said transport rack, said dripping preventing device comprises a stationary partition member which has a window for passage of the photosensitive material and which covers said part of said inlet guide section, and a movable partition member which closes and opens said window, whereby the processing solution is prevented from dripping onto said part of said inlet guide section.

11. A photosensitive material processing apparatus in which a transport rack is provided and a photosensitive material is immersed into a processing tank filled with a processing solution such as a developing solution for processing said photosensitive material, said apparatus comprising:

an inlet guide section provided at an inlet section of said processing tank and adapted to contact said photosensitive material before immersion to feed said photosensitive material into said processing tank;

an outlet guide section provided at an outlet section of said processing tank and adapted to contact said photosensitive material after immersion to feed out said photosensitive material;

a holding member for holding said inlet guide section and said outlet guide section together, and removable from said transport rack; and a partition member for preventing the processing solution adhering to said outlet guide section from dripping onto said inlet guide section in a state in which said holding member is removed from said transport rack, said partition member having a tip portion which projects toward said processing tank from a straight line connecting a lowermost portion of said inlet guide section which faces said processing tank, and a lowermost portion of said outlet guide section which faces said processing tank.

12. A photosensitive material processing apparatus according to claim 11, wherein said tip portion is provided with a small projection which projects toward said outlet guide section to prevent said processing solution from reaching said inlet guide section side from said outlet guide section side.

13. A photosensitive material processing apparatus in which a transport rack which rotatably supports transport rollers, is provided and a photosensitive material is transported by said transport rollers so that said photosensitive material is immersed into a processing tank filled with a processing solution such as a developing solution for processing said photosensitive material, said apparatus comprising:

an inlet guide roller disposed at an inlet of said processing tank above the surface of the processing solution and adapted to contact said photosensitive material to guide said photosensitive material into said processing tank; and a one-way clutch for transmitting drive force to said inlet guide roller from a drive source which drives said transport rollers supported by said transport rack and for allowing said inlet guide roller to independently rotate in the direction of feed of said photosensitive material.

14. A photosensitive material processing apparatus in which a photosensitive material is immersed into a processing tank filled with a processing solution such as a developing solution for processing said photosensitive material, said apparatus comprising:

an inlet guide section provided at an inlet section of said processing tank and operative to contact said photosensitive material before immersion to feed said photosensitive material into said processing tank;

an outlet guide section provided at an outlet section of said processing tank and operative to contact said photosensitive material after immersion to feed out said photosensitive material from said processing tank;

a first door member for opening and closing an opening leading into said inlet guide section to isolate said inlet guide section from outside air;

a second door member for opening and closing an opening leading out of said outlet guide section to isolate said outlet guide section from said outside air; and a third door member utilizing a drive device for opening and closing an opening between said inlet guide section and said processing tank containing said processing solution, thereby to isolate said inlet guide section from said processing solution and prevent condensation and splashing of said processing solution on said inlet guide section.

15. A photosensitive material processing apparatus in which a photosensitive material is immersed into a processing tank filled with a processing solution such as a developing solution for processing said photosensitive material, said apparatus comprising:

an inlet guide roller provided at an inlet section of said processing tank and operative to feed said photosensitive material before immersion into said processing tank;

a stationary guide provided between said inlet guide roller of said processing tank and said processing tank to guide said photosensitive material which runs from said inlet guide roller to said processing tank; and an extension arm serving as an adhesion preventing member for preventing the processing solution which splashes due to contact between said photosensitive material and said stationary guide from adhering to said inlet guide roller.

16. A photosensitive material processing apparatus in which a photosensitive material is immersed into a processing tank filled with a processing solution such as a developing solution for processing said photosensitive material, said apparatus comprising:

an inlet guide roller provided at an inlet section of said processing tank and operative to contact said photosensitive material before immersion to feed said photosensitive material into said processing tank;

a stationary guide provided between said inlet guide roller of said processing tank and said processing tank to guide said photosensitive material which runs from said inlet guide roller to said processing tank; and an adhesion preventing member for preventing the processing solution which splashes due to contact between said photosensitive material and said stationary guide from adhering to said inlet guide roller, wherein said adhesion preventing member comprises an extension arm which projects from an upper end of said stationary guide to form an arcuate shape, so that said stationary guide has a generally L-like shape.

* * * * *